US010440808B2

(12) United States Patent
Poenitzsch et al.

(10) Patent No.: US 10,440,808 B2
(45) Date of Patent: Oct. 8, 2019

(54) HIGH POWER IMPULSE PLASMA SOURCE

(71) Applicant: Southwest research Institute, San Antonio, TX (US)

(72) Inventors: Vasiliki Zorbas Poenitzsch, Alamo Heights, TX (US); Ronghua Wei, San Antonio, TX (US); Kent E. Coulter, Boerne, TX (US); Edward Langa, San Antonio, TX (US)

(73) Assignee: SOUTHWEST RESEARCH INSTITUTE, San Antonio, TX (US)

( * ) Notice: Subject to any disclaimer, the term of this patent is extended or adjusted under 35 U.S.C. 154(b) by 0 days.

(21) Appl. No.: 14/944,017

(22) Filed: Nov. 17, 2015

(65) Prior Publication Data

US 2017/0142819 A1 May 18, 2017

(51) Int. Cl.
*H05H 1/46* (2006.01)

(52) U.S. Cl.
CPC ..... *H05H 1/46* (2013.01); *H05H 2001/4682* (2013.01)

(58) Field of Classification Search
CPC ..... H05H 1/46; H05H 1/24; H05H 1/2406; H05H 1/30; H05H 1/34; H05H 1/36; H05H 1/38; H05H 1/48; H05H 1/52; H05H 2001/2412; H05H 2001/2418; H05H 2001/2425; H05H 2001/2443; H05H 2001/2456; H05H 2001/2462; H05H 2001/3426; H05H 2001/3431; H05H 2001/3452; H05H 2001/3468; H05H 2001/3494; H05H 2001/466; H05H 2001/4682; H05H 2001/481; H05H 2240/10; H05H 2240/20; H05H 2245/1215; H05H 2245/122; H05H 2245/123; H05H 2245/125; H05H 2277/10; H05H 2277/13; H01L 21/3065; H01L 21/31116; H01L 21/32136; H01L 21/02337; H01L 21/0234; H01L 21/02658; H01L 21/28; H01L 21/311; H01L 21/31138
See application file for complete search history.

(56) References Cited

U.S. PATENT DOCUMENTS 3,376,211 A 4/1968 Bjornson
3,644,782 A 2/1972 Sheer et al.
3,649,805 A 3/1972 Rohrberg
(Continued)

OTHER PUBLICATIONS

Atmospheric-Pressure Plasma <<https://en.wikipedia.org/wiki/Atmospheric-pressure_plasma>> (accessed Nov. 18, 2015).
(Continued)

*Primary Examiner* — Seokjin Kim
(74) *Attorney, Agent, or Firm* — Grossman, Tucker, Perreault & Pfleger, PLLC

(57) ABSTRACT

A method and system for generating a surface treating plasma. Gas is provided to a power conducting electrode and flows through the power conducting electrode. Power pulses are applied to the power conducting electrode in the range of 40 kW to 100 kW with a DC generator, at a frequency in the range of 1 Hz to 62.5 kHz, and with a pulse duration in the range of 0.1 microseconds to 3,000 microseconds. Peak currents in the range of 100 Amps to 400 Amps are produced and plasma is formed from the gas. A substrate surface may then be treated with the plasma.

18 Claims, 19 Drawing Sheets

(56) References Cited

U.S. PATENT DOCUMENTS

| | | | | |
|---|---|---|---|---|
| 4,048,465 | A | 9/1977 | Manz | |
| 4,055,741 | A | 10/1977 | Bykhovsky et al. | |
| 5,248,371 | A | 9/1993 | Maher et al. | |
| 5,874,134 | A | 2/1999 | Rao et al. | |
| 6,001,426 | A | 12/1999 | Witherspoon et al. | |
| 6,124,563 | A | 9/2000 | Witherspoon et al. | |
| 6,274,837 | B1 | 8/2001 | Windishmann et al. | |
| 6,287,642 | B1 | 9/2001 | Leutsch et al. | |
| 6,472,632 | B1 | 10/2002 | Peterson et al. | |
| 6,706,993 | B1 | 3/2004 | Chancey et al. | |
| 7,147,759 | B2 | 12/2006 | Chistyakov | |
| 8,277,617 | B2 | 10/2012 | Chiang et al. | |
| 8,328,982 | B1 | 12/2012 | Babayan et al. | |
| 8,496,992 | B2 | 7/2013 | Wei et al. | |
| 8,629,371 | B2 | 1/2014 | Oberste-Berghaus et al. | |
| 8,866,038 | B2 | 10/2014 | Lindsay et al. | |
| 2001/0006093 | A1 | 7/2001 | Tabuchi et al. | |
| 2002/0053557 | A1 | 5/2002 | Peterson et al. | |
| 2002/0129902 | A1* | 9/2002 | Babayan | C23C 16/402 156/345.45 |
| 2003/0230554 | A1 | 12/2003 | Schroder et al. | |
| 2004/0060813 | A1* | 4/2004 | Chistyakov | C23C 14/35 204/192.12 |
| 2004/0173583 | A1 | 9/2004 | Iriyama et al. | |
| 2005/0106435 | A1 | 5/2005 | Jang et al. | |
| 2008/0139003 | A1* | 6/2008 | Pirzada | C23C 16/509 438/785 |
| 2008/0145553 | A1 | 6/2008 | Boulos et al. | |
| 2011/0220490 | A1 | 9/2011 | Wei et al. | |
| 2013/0264317 | A1 | 10/2013 | Hoffa et al. | |
| 2014/0041805 | A1* | 2/2014 | Kuga | H01J 37/02 156/345.33 |
| 2014/0154415 | A1* | 6/2014 | Tomyo | C23C 16/24 427/248.1 |
| 2014/0186540 | A1 | 7/2014 | Schramm et al. | |
| 2016/0165713 | A1* | 6/2016 | Yuzurihara | H05H 1/46 315/111.21 |
| 2016/0329193 | A1* | 11/2016 | Sieber | H01J 37/32449 |
| 2016/0351413 | A1* | 12/2016 | Schmidt | H01L 29/1604 |
| 2017/0175253 | A1* | 6/2017 | Chistyakov | C23C 14/354 |
| 2017/0243727 | A1 | 8/2017 | Poenitzsch et al. | |
| 2018/0240656 | A1 | 8/2018 | Gorokhovsky | |

OTHER PUBLICATIONS

Kouznetsov, V., et a; "A Novel Pulsed Magnetron Sputter Technique Utilizing Very High Target Power Densities," Surface and Coatings Technology, vol. 122 (1999), pp. 290-293.

Lin, J., et al; "Ion Energy and Mass Distributions of the Plasma During Modulated Pulse Power Magnetron Sputtering", Surface Coatings Technology, vol. 203 (2009) pp. 3676-3685.

Schutze, A., et al; "The Atmospheric-Pressure Plasma Jet:: A Review and Comparison to Other Plasma Sources". IEEE Transactions on Plasma Science, vol. 26, No. 6, Dec. 1998, pp. 1685-1694.

Office Action, dated Apr. 11, 2017, issued in related U.S. Appl. No. 15/0416,600 (14 pgs).

Office Action, dated Oct. 23, 2017, issued in related U.S. Appl. No. 15/046,600 (20 pgs).

Office Action, dated Jul. 16, 2018, issued in related U.S. Appl. No. 15/046,600 (27 pgs).

J. Robertson; Excerpt from "Tribology of Diamond Like-Carbon Films": Fundamentals and Applications, 13 (Christophe Donnet & Ali Erdemir, eds., Springer 2008).

A. Grill; Excerpt from "Electrical and Optical Properties and Applications of Diamond-Like Carbon", Diamond Materials VI: Proceedings of the Sixth International Symposium, vol. 99-32, 252 (J.L Davidson, W.D. Brown, A. Gicquel, et al., eds., The Electrochemical Society 2000).

D.C. Harris, Excerpt from "Materials for Infrared Windows and Domes", 258 (SPIE 1999).

Notice of Allowance, dated Mar. 7, 2019, issued in related U.S. Appl. No. 15/046,600 (9 pgs).

* cited by examiner

HiPIPS Ar/$H_2$ Plasma

HiPIPS Ar/$CH_4$ Plasma

HiPIPS $H_2/CH_4$ Plasma

HIGH POWER IMPULSE PLASMA SOURCE

GOVERNMENT SUPPORT CLAUSE

This invention was made with United States Government support under Contract No. HR0011-13-C-0008 from the Defense Advanced Research Projects Agency. The Government has certain rights in this invention.

FIELD

The present disclosure relates to a high power impulse plasma source system, using a pulsed DC generator with a plasma jet head, and related processing methods. The system and methods may be used to deposit many classes of films as well as perform various surface treatments including surface modification, cleaning and etching.

BACKGROUND

Vapor deposition may be employed in various surface treatments including etching, coating deposition, and cleaning. Vapor deposition processes include chemical and physical processes. Generally, in chemical vapor deposition a gaseous precursor is provided to a reactor containing a substrate. The gas reacts or decomposes to treat a surface. In physical vapor deposition a metal or ceramic may be ejected from a source and deposited on a substrate surface to form a coating. Various combinations of chemical and physical vapor deposition processes may be utilized as well. Coatings deposited in these processes may improve the wear resistance, oxidation characteristics, hardness, purity, or lubricity of the surfaces that are treated.

Plasma may often be generated during vapor deposition from precursors or inert gasses to assist in surface modification. The plasma may be generated through the application of an electric current, often at radio frequencies, to a coil or a pair of electrodes proximal to the gas. The gas may then be ionized and form a plasma. However, the processing chamber may need to be maintained at pressures of 1 mTorr to 50 mTorr. Further, the coil or electrode geometry may limit the source to substrate distance. In addition, the processing temperatures of some plasmas may be relatively high, greater than 300° C., and degrade the substrates. Accordingly, room for improvement remains in the development of chemical vapor deposition processes.

SUMMARY

An aspect of the present disclosure relates to a method of generating a surface treating plasma. Supplying a gas to a power conducting electrode, wherein the gas flows through the power conducting electrode. Power pulses may be applied to the power conducting electrode with a DC generator in the range of 40 kW to 100 kW at a frequency in the range of 0.1 Hz to 62.5 kHz, and with an individual pulse duration in the range of 0.1 microseconds to 3,000 microseconds, providing peak currents in the range of 100 Amps to 400 Amps and forming a plasma from the gas. The surface of a substrate may be treated with the plasma.

Another aspect of the present disclosure relates to a high power impulse plasma source apparatus. The apparatus may include a power conducting electrode and a DC generator coupled to said power conducting electrode, wherein the DC generator is configured to provide power pulses in the range of 40 kW to 100 kW at a frequency in the range of 0.1 Hz to 62.5 kHz, and with an individual pulse duration in the range of 0.1 microseconds to 3,000 microseconds, providing peak currents in the range of 100 Amps to 400 Amps. The apparatus may also include a gas supply configured to deliver gas through the power conducting electrode.

BRIEF DESCRIPTION OF THE DRAWINGS

The above-mentioned and other features of this disclosure, and the manner of attaining them, may become more apparent and better understood by reference to the following description of embodiments described herein taken in conjunction with the accompanying drawings, wherein.

DESCRIPTION

Figure 1:
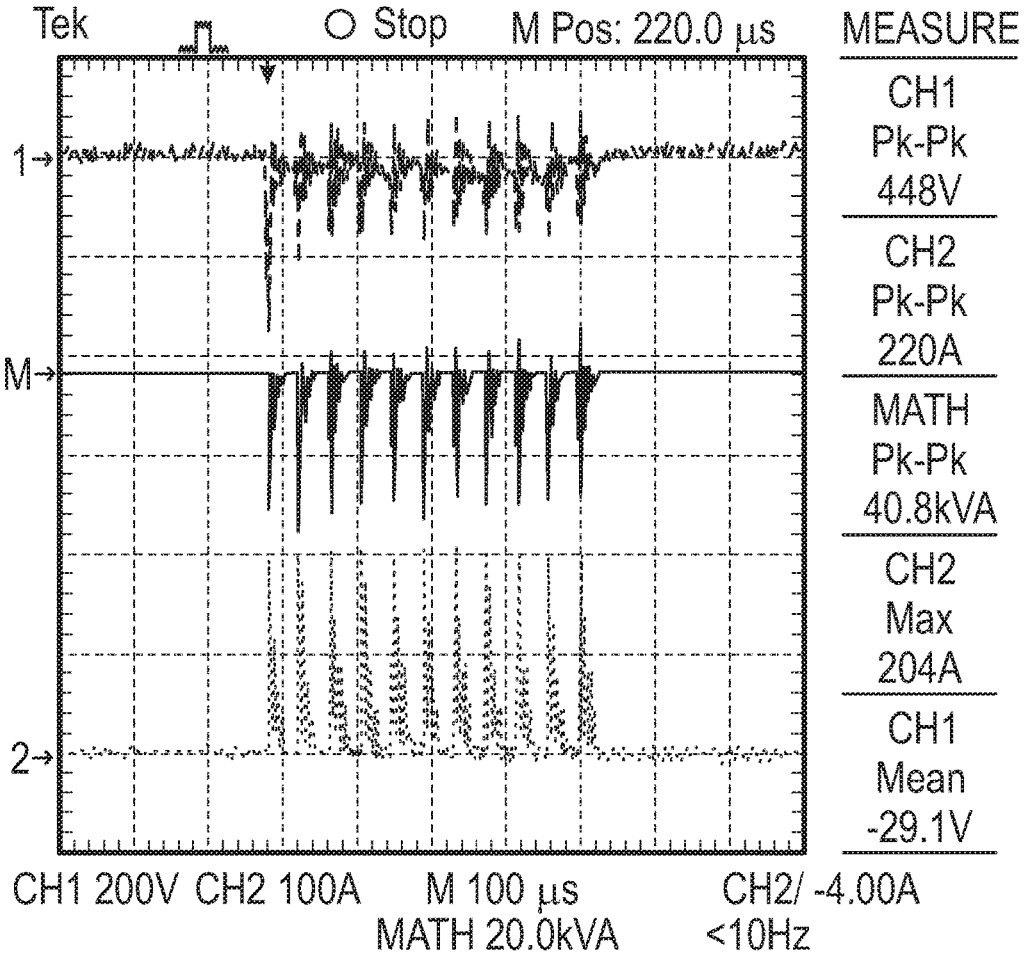
FIG. 1 illustrates an example of high peak power pulses obtained using an embodiment of a high power pulsed DC generator.

The present disclosure relates to a high power impulse plasma source system, using pulsed DC generators, and related processing methods. The system and methods deposit many classes of films as well as perform various surface treatments including surface modification, cleaning and etching. In particular, the present disclosure is directed to the use of a relatively high power impulse plasma source in combination with atmospheric pressure plasma jets.

In embodiments of the high power impulse plasma source systems and methods herein, with gases flowing through one or more electrodes, high impulse power is applied to the plasma source to generate and maintain the plasma and, in particular embodiments non-thermal plasma, with a relatively high flux of reactive species available to impinge on the substrate. A non-thermal plasma may be understood as a plasma that is not in thermodynamic equilibrium, wherein the temperature of electrons in the plasma is relatively high as compared to the temperature of the heavy neutral particles and ions. For example, the temperature of the electrons may be on the order of 1 eV, whereas the temperature of the gas may be close to room temperature.

Without being bound to any particular theory, free electrons in the plasma may be accelerated by the current applied to the electrodes and enter into collisions with gas molecules. The inelastic collisions may produce various reactive species (excited atoms and molecules, free radicals, etc.) that exit the source at a relatively high velocity. A relatively high flow rate of gas may decrease the transit times and prevent recombination or loss of the active, chemical species. In the embodiments herein, flow rates in the range of 1 to 10 standard liters per minute (slm) may be utilized. Further, the high power impulse plasma source may operate at pressures in the range of 50 mTorr to 760 Torr, including all values and ranges therein.

The high power impulse plasma source systems and methods herein may use different types of high power pulsed DC generators that may provide different peak power pulse wave forms. The high power pulsed DC generators are understood to be able to deliver the required high power during each pulse, as they may exhibit a peak power in the range of 40 kW to 100 kW, including all values and ranges therein. Peak currents may range from 100 Amps to 1000 Amps, including all values and ranges therein, such as 100 Amps to 400 Amps, 175 Amps to 250 Amps, etc.

The frequency of the pulses may be in the range of 0.1 Hz to 62.5 kHz, including all values and ranges therein, such as 0.1 Hz to 62.5 kHz, 0.1 Hz to 5 Hz, etc. When the pulses are modulated, the frequency of pulse packages may be in the range of 0.1 Hz to 5 Hz, including all values and ranges therein, and the frequency of individual pulses within the pulse packages may be in the range of 1 kHz to 62.5 kHz, including all values and ranges therein. The pulse duration, or width, may be in the range of 0.1 microseconds to 100 microseconds and 3,000 microseconds. When the pulses are modulated, the duration of pulse packages may be in the range of 400 microseconds to 3,000 microseconds and the duration of individual pulses within the pulse packages maybe in the range of 1 to 10 microseconds, including all values and ranges therein.

The overall average power may be in the range of 10 W to 1000 W, including all values and ranges therein, such as 35 W to 100 W. The average power per pulse is defined herein as the average power for the duration of the pulse in time. The peak power in the pulse and the average power per pulse are related to the intensity and hence the fragmentation of molecules in the plasma. The overall average power is understood herein as the average power for the duration of the pulse period (time on plus the time off). The overall average power is related to the heat flux delivered to the part. Further, ionization and plasma density may increase as compared to RF systems (as seen in optical emission and mass/energy spectroscopy). Increased ionization and density as compared to AC and non-pulsed DC systems has also been observed. Yet, due to the low average power, the substrate processing temperature may be maintained on the order of 30° C. to 150° C., including all values and increments therein, such as 50° C. to 150° C.

Figure 2:
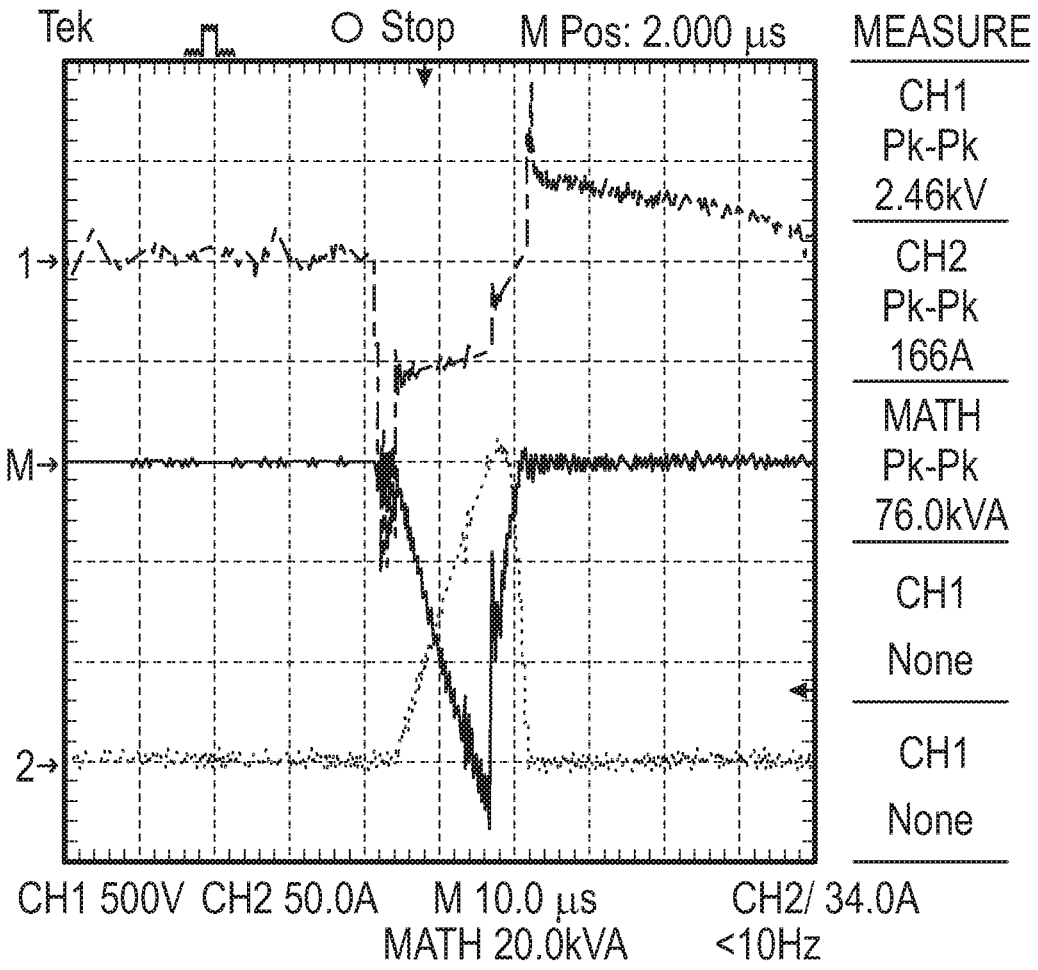
FIG. 2 illustrates another example of high peak power pulses obtained using an embodiment of a high power pulsed DC generator.

FIGS. 1 and 2 illustrate different power pulses output by different examples of DC generators. Provided in FIG. 1 is an example of high peak power pulses obtained using a pulsed DC generator. Specifically, in the example, a Zpulser, Inc. pulsed DC generator was used in multi-pulsed mode. The pulsed DC generator produces packages of long pulses with a pulse width in the range of 400 microseconds to 3,000 microseconds with a frequency in the range of 0.1 Hz to 5 Hz as shown in FIG. 1. Each long pulse package is further modulated with short pulses with a pulse width of 1 microsecond to 10 microseconds and a frequency in the range of 1 kHz to 20 kHz as shown in FIG. 1. Provided in FIG. 2 is an example of relatively high peak power pulses obtained using a Plasma Technologies Inc. single pulsed DC generator that produces individual pulses with a pulse width in the range of 5 microseconds to 30 microseconds and the frequency in the range of 100 Hz to 5,000 Hz.

A variety of gas chemistries may be employed in the systems and methods described herein. For example, inert gases such as Ar or He may be employed. Precursor gasses may also be employed, such as $CH_2$, $CH_4$, $CH_2CH_2$, $B_2H_6$, $SiH_4$, $H_2$, $N_2$ and $O_2$. Precursors may also be stored as a liquid and supplied in as a gas or in vapor form. Such liquids may include $C_6H_{18}OSi_2$, $O[Si(CH_3)_3]_2$ (hexamethyldisiloxane), $TiCl_4$, and $BCl_3$. Gas combinations such as inert and reactive gasses may be employed. Non-limiting examples may include $Ar/H_2$, $Ar/H_2/CH_4$, $Ar/O_2$, and $H_2/CH_4$. Other gasses such as $N_2$, CO, $NH_3$, $C_3F_6O$, $C_3H_{10}Si$ (trimethylsilane) may also be employed, alone or in combination with the inert and reactive gasses already set forth.

Figure 3:
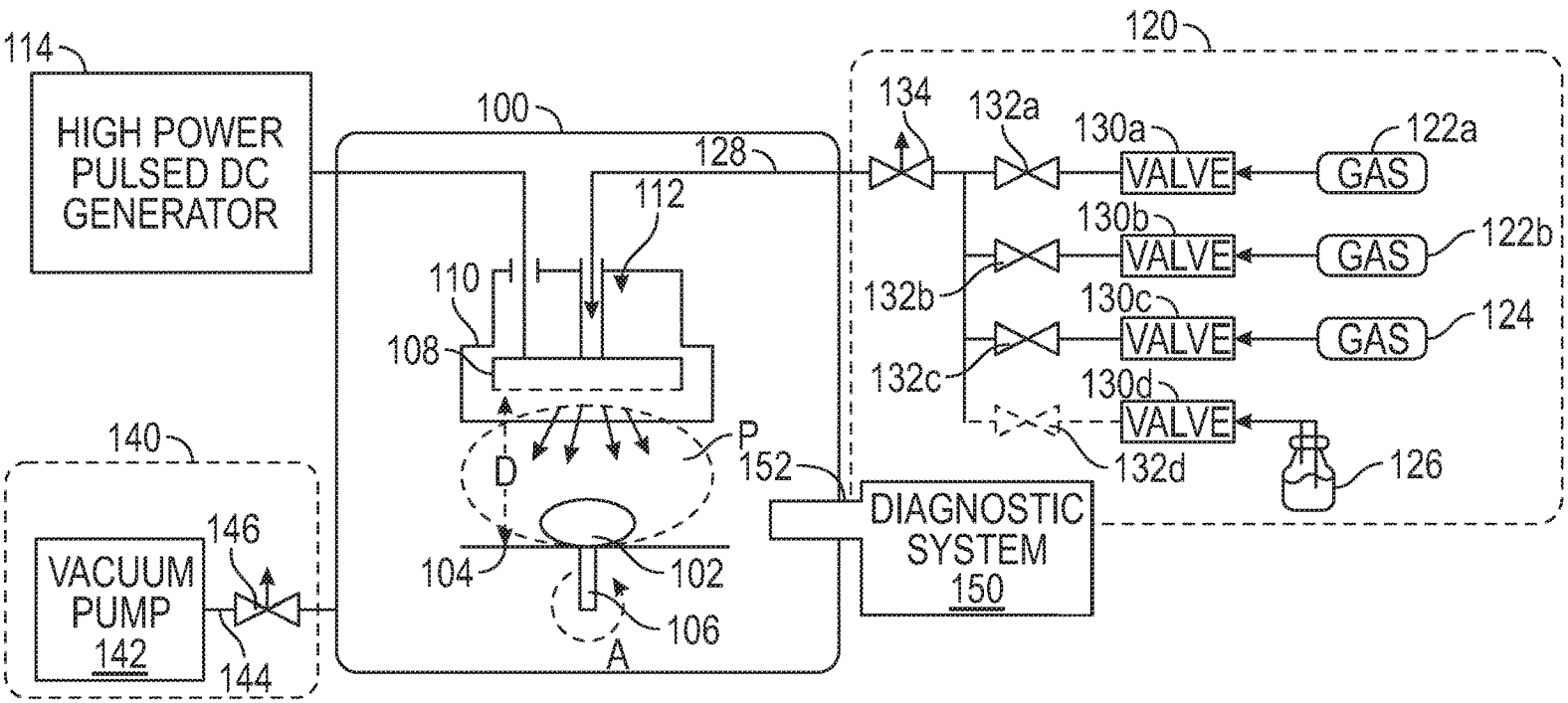
FIG. 3 illustrates a schematic of an embodiment of a perforated powered electrode.

FIG. 3 illustrates an example of a system for use herein. The system includes a process chamber 100. A substrate 102 may be positioned on a substrate holder 104 within the process chamber 100. The substrate 102 and/or substrate holder 104 may, in embodiments, be grounded. In particular embodiments, the substrate holder 104 may be rotatable around an axis 106 in the direction of arrow A. A perforated power conducting electrode 108 may be provided within a gas nozzle 110 to provide a high power impulse plasma source 112. The power conducting electrode may be placed at any working distance D in the range of 1 mm to 80 mm from the substrate holder, including all values and ranges therein. The electrode 108 may be circular in shape; however, other geometries may be assumed as well. A high power pulsed direct current (DC) generator 114 may be electrically connected to the electrode via one or more conducting wire and may supply the electrode with the peak power pulses described above.

A gas supply system 120 may be provided to supply inert gas, precursor gasses or both to the high power impulse plasma source 112. The gas supply system 120 may include one or more gas cylinders or liquid tanks for the inert and precursor gasses. For example, as illustrated one or more precursor gas cylinders 122*a*, 122*b* may be provided, as well as an inert gas cylinder 124 and a precursor liquid gas tank 126. Inlet supply lines 128 coupled to the supply cylinders and tanks may provide the gas to the plasma source 112 and process chamber 100. The flow of the gasses or vapor may be regulated by flow control valves or flow meters 130*a*, 130*b*, 130*c*, 130*d*, such as master flow control valves. Various other valves that control the flow may also be provided 132*a*, 132*b*, 132*c*, 132*d*, 134 in the inlet supply lines 128 between the flow control valves and the plasma source 112. Such valves may include, for example, gate valve, pressure relief valves, check valves, etc. The gas may be provided into the gas nozzle 110 and flow through the perforations of the electrode 108. The current applied to the power conducting electrode may cause the gas atoms to dissociate into various atomic species, including free electrons, neutral particles and ions, forming plasma P. The free electrons in the plasma may enter into collisions with other gas molecules producing various reactive species (excited atoms and molecules, free radicals, etc.).

An outlet system 140 may also be provided. The outlet system 140 may include a vacuum pump 142 coupled to the process chamber by an outlet supply line 144. Additional valves 146 may also be provided in the outlet supply line 144 between the vacuum pump 142 and the process chamber 100. The vacuum pump 142, optionally in combination with the valves 146, may be used to control the flow of the gasses through the processing chamber.

Plasma diagnostics 150 may also be provided to measure the quality of the plasma and other process characteristics in the process chamber 100. Plasma diagnostics may include, for example, optical emission spectroscopy, threshold ionization mass spectroscopy, high voltage and current probes, oscilloscope, Langmuir probes and thermocouples to measure substrate temperature. Other diagnostic equipment may be provided as well. Diagnostic sensors may be inserted into the process chamber through an opening 152 in a side of the process chamber.

Figure 4:
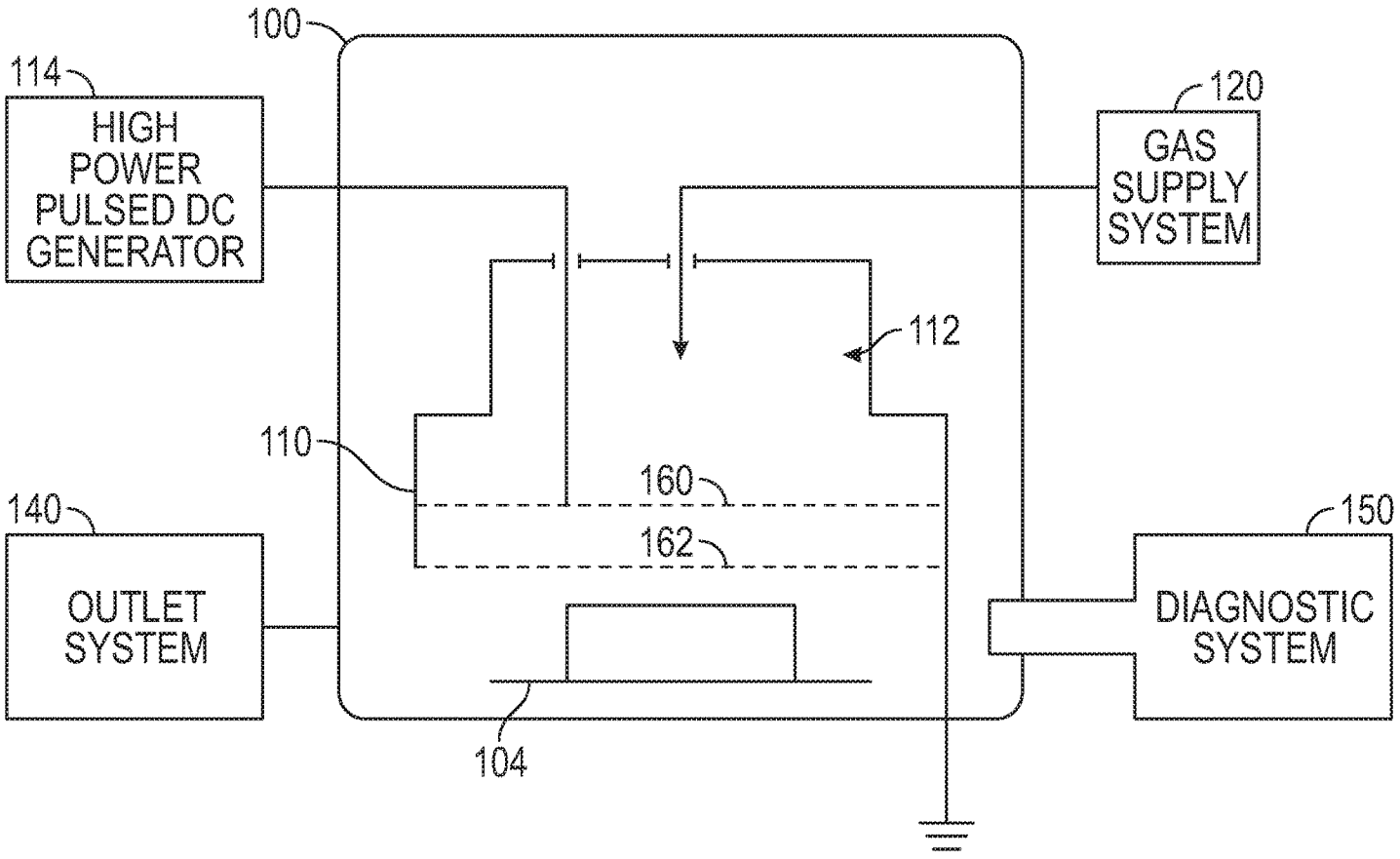
FIG. 4 illustrates a schematic of an embodiment of parallel perforated powered and grounded electrodes.

Various other arrangements of the plasma source may be provided as well. FIG. 4 illustrates another embodiment of a plasma source 112. As in FIG. 3, the plasma source of FIG. 4 includes a perforated power conducting electrode 160 positioned in a gas nozzle 110. A grounded electrode 162 is also provided in the gas nozzle positioned downstream from the power conducting electrode, between the power conducting electrode and the substrate holder 104. The gas and plasma may pass through the perforations of the power conducting electrode and then through the grounded electrode before it reaches the substrate. This arrangement may deliver the sample with active neutrals (excited atoms and molecules) and radicals (atoms, molecules or ions with unpaired valance electrons). Otherwise, the system may be similar to that described above, including a substrate holder 104, a high power pulsed DC generator 114, a gas supply system 120, an outlet system 140 and a diagnostic system 150.

Figure 5:
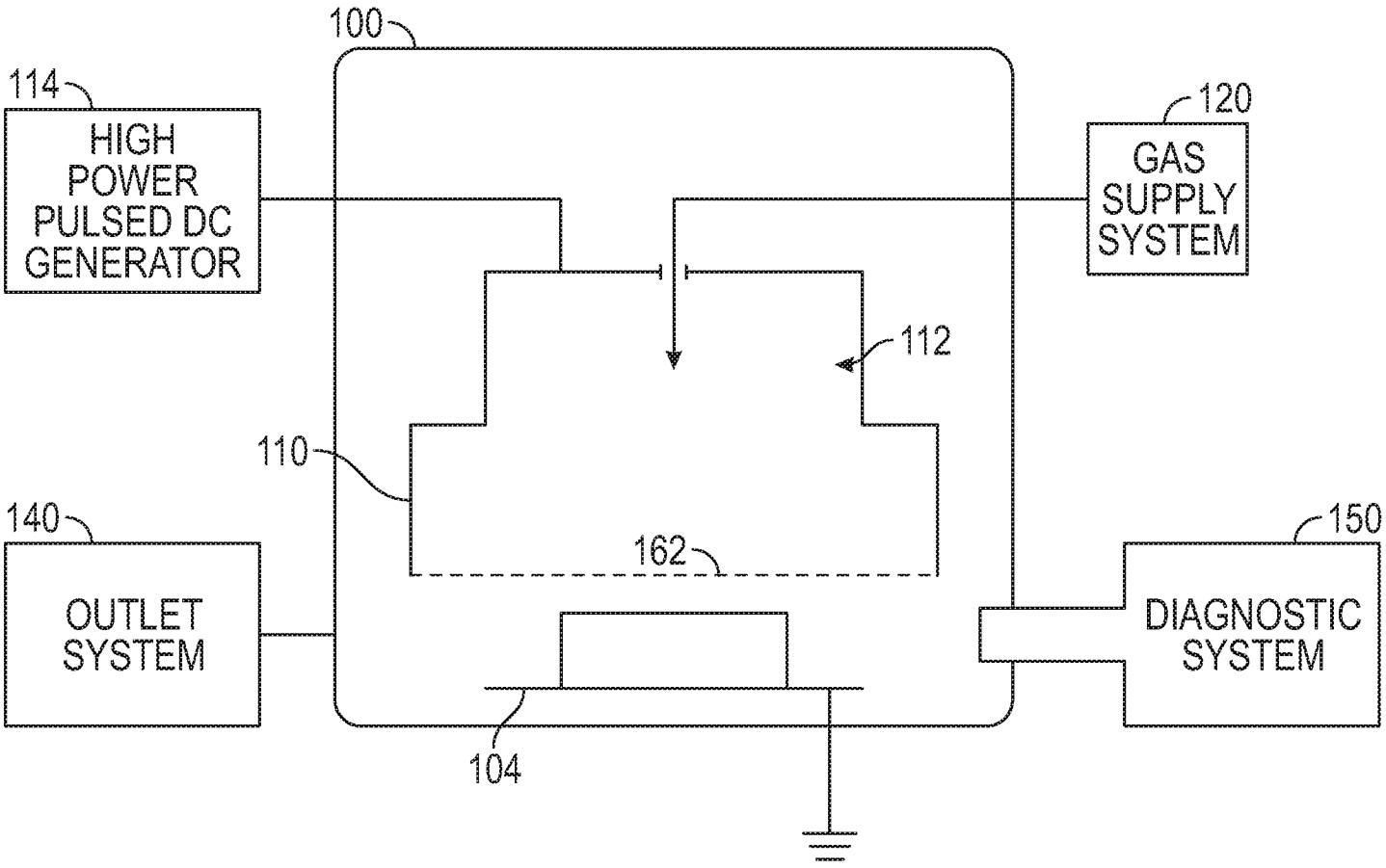
FIG. 5 illustrates a schematic of another embodiment of a perforated powered electrode.

FIG. 5 illustrates yet another embodiment of a plasma source 112. As in FIG. 3, the plasma source of FIG. 5 includes a gas nozzle 110 that is connected electrically with a perforated electrode 162 positioned at the outlet of the gas nozzle. The pulsed power is connected to the gas nozzle 110 including the electrode 162. The substrate holder 104 and the processing chamber 100 may be grounded. The gas and plasma may pass through the perforation of the power conducting electrode 162 and reach the substrate. The plasma may also be generated between the electrode 162 and the substrate 104 (the ground). This arrangement may deliver the sample with active neutrals (excited atoms and molecules) and radicals (atoms, molecules or ions with unpaired valance electrons). Otherwise, the system may be similar to that described above, including a high power pulsed DC generator 114, a gas supply system 120, an outlet system 140 and a diagnostic system 150.

Figure 6:
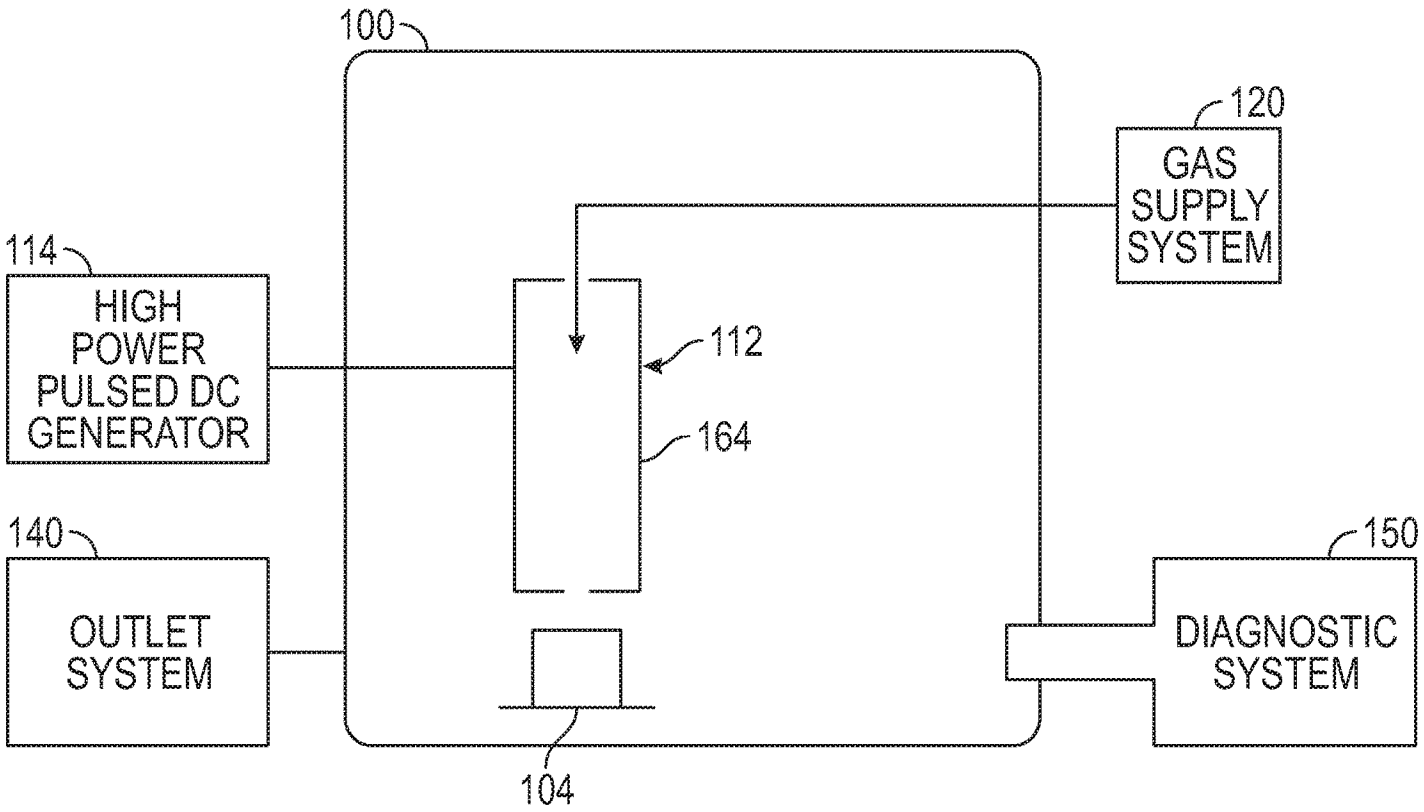
FIG. 6 illustrates a schematic of an embodiment of a micro-hollow cathode.

FIG. 6 illustrates yet another embodiment of a plasma source 112. In this embodiment, the gas nozzle and power conducting electrode are combined into one element, a hollow cathode 164. The cathode opening, closest to the substrate holder, may be in the range of 10 micrometers to 5 mm, including all values and ranges therein. The gas flows through the hollow cathode 164 and the hollow cathode 164 is powered with a high power pulsed DC generator 114. The system may otherwise be similar to that described above with respect to FIG. 3, including a substrate holder 104, a high power pulsed DC generator 114, a gas supply system 120, an outlet system 140 and a diagnostic system 150. It may be appreciated that the various embodiments of the plasma sources may be combined where more than one source may be used in a single application.

The plasma generated may be employed for a number of processes as mentioned above. Non-limiting examples of such processes may include film deposition, surface etching, surface chemical modification, surface cleaning and combinations thereof. In particular, in using methane or other carbon based gasses, diamond like carbon coatings may be deposited. In a method of operation, the pressure in the process chamber may initially be reduced to a pressure in the range of 5 mTorr to 760 mTorr, including all values and ranges therein, such as greater than 5 mTorr to 760 mTorr, 100 mTorr to 760 mTorr, 400 mTorr to 760 mTorr, 500 mTorr to 760 mTorr. The pressure may be maintained throughout the process. The gasses, including inert gas, precursor gasses, precursor vapors or combinations thereof, may be introduced into the gas nozzle of the plasma supply from the gas supply system by way of the inlet supply lines. The gasses may be introduced into the process chamber at flow rates in the range of 0.1 to 10 standard liters per minute, including all values and ranges therein.

Power may be applied to the power conducting electrode by a high power pulsed DC generator while gas or vapor is flowing through the electrode. As noted above, the generator may supply the peak power pulses in the range of 40 kW to 100 kW, including all values and ranges therein, such as from 65 kW to 85 kW. Peak currents may be in the range of 100 Amps to 400 Amps including all values and ranges therein, such as in the range of 175 Amps to 250 Amps, including all values and ranges therein. The power may be applied in pulses at a frequency in the range of 1 Hz to 5000 Hz, including all values and ranges therein and individual pulses may range in duration from 0.1 microseconds to 100 microseconds, including all values and ranges therein. The individual power pulses may be further modulated with packages of long pulses exhibiting a pulse width of 400 microseconds to 3000 microseconds and a pulse frequency of 0.1 Hz to 5 Hz. In embodiments, the frequency and/or modulation may be varied over the course of a process cycle. The overall average power, i.e., average power, applied may be in the range of 10 W to 1000 W, including all values and ranges therein, may be applied to the electrodes.

It is understood that the plasma generated herein contains electrons, ions of various species and a variety of neutrals at various states including ground-state and excited atoms, molecules, free radicals and other particles. The plasma may be propelled to the substrate, positioned on a substrate holder, which may be rotated during processing. Depending on the chemistry, concentrations, pressures and temperatures, various surface modifications may occur to the substrate. Again, the plasma may be thermal or non-thermal. In addition, particularly in the case of non-thermal plasma, the temperatures may be controlled in the range of 30° C. to 150° C., including all values and ranges therein, allowing processing of substrates that may be susceptible to degradation at higher processing temperatures. Such materials include, for example, thermoplastics such as polycarbonate.

The plasmas produced by the systems and methods herein are relatively more intense than processes using RF or AC power supplies as will be demonstrated further herein. It has been unexpectedly found that relatively more ionization, dissociation and flux may be obtained in the present process as compared to processes that use RF or AC power supplies. Using the process herein may result in a three order of magnitude increase in the pulse peak power and a two order of magnitude increase in the pulse peak current while maintaining overall average power. Not only are more neutral Ar species generated, but also a much higher fraction of Ar ions, (an increase of two to three orders of magnitude as measured by secondary ion mass spectrometry), is generated in the present process which is generally not exhibited by RF or AC processes.

Ion and radical fluxes produced by the systems and methods herein may include an ion flux on the order of $1\times10^{19}$ $cm^{-2}s^{-1}$ and a radical flux on the order of $1\times10^{18}$ $cm^{-2}s^{-1}$ as compared to an ion flux on the order of $1\times10^{15}$ $cm^{-2}s^{-1}$ and a radical flux on the order of $1\times10^{12}$ $cm^{-2}s^{-1}$ using RF or AC powered processes. The increase in ionization may result in lower defect, denser films being produced by the present process. Ion energy produced in the systems and processes herein may be less than 10 eV, whereas ion energy produced in RF and AC systems may be in the range of 30 eV to 100 eV. The lower ion energies may provide films exhibiting relatively lower stress with improved durability and adherence as compared to other processes applying similar overall power.

Examples

Figure 7A:
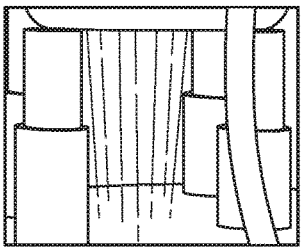
FIG. 7*a* is an image of argon/hydrogen gas plasma produced by a high power impulse plasma source as described herein.
Figure 7B:
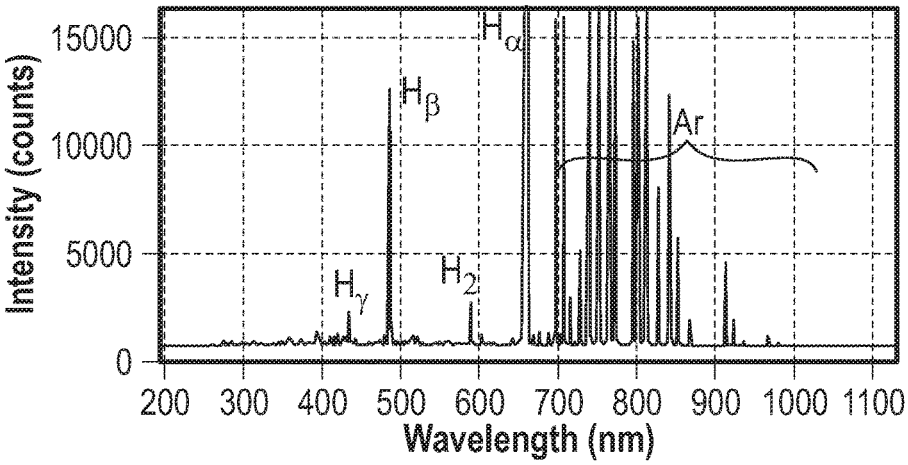
FIG. 7*b* illustrates an optical emission spectrograph of the argon/hydrogen gas plasma of FIG. 7*a;*
Figure 7C:
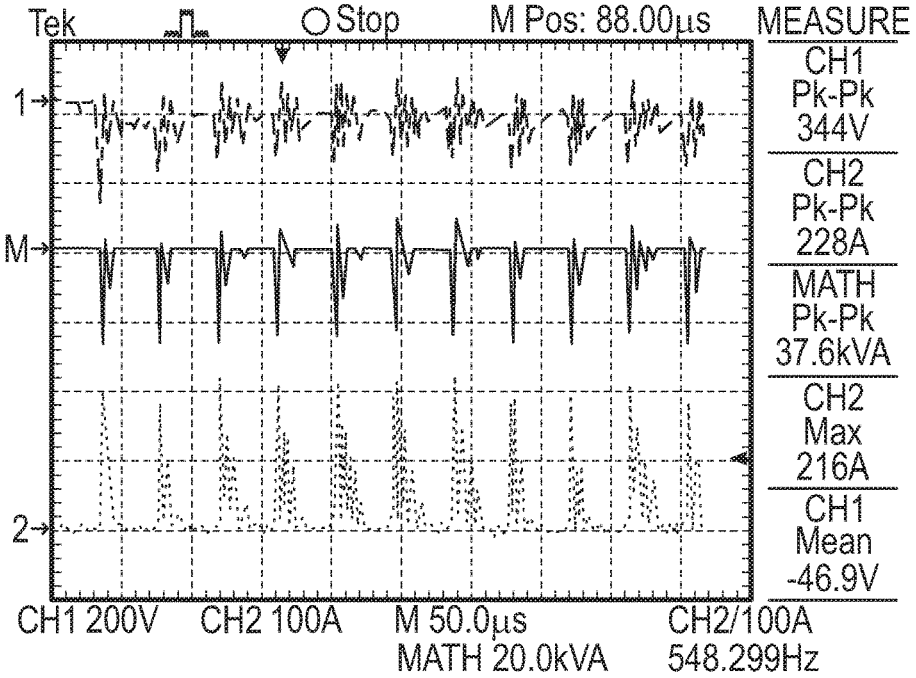
FIG. 7*c* illustrates an example of high peak power pulses applied to generate and maintain the argon/hydrogen gas of FIG. 7*a;*

Examples one through three use molecular gasses with carrier gasses in the high power impulse plasma source system and methods. In example one, $H_2$ gas was introduced into the process chamber of FIG. 3 with an Ar carrier gas. The process chamber was maintained at a pressure of 0.5 Torr. $H_2$ gas was introduced at a flow rate of 200 sccm and Ar was introduced at a flow rate of 3500 sccm. Power was applied to the power conducting electrode of the plasma source at 500 V in 20 microsecond pulses at a frequency of 500 Hz to obtain an average power of 200 W with peak powers of 42.4 kW and peak currents at 204 Amps. FIG. 7*a* is an exemplary image of the $Ar/H_2$ plasma generated using the above process conditions. FIG. 7*b* is an example of an analysis of the plasma using optical emission spectroscopy indicating the presence of Ar, H, and $H_2$ species in the plasma. FIG. 7*c* is an example of the power pulses applied to the electrode over time during the process.

Figure 8A:
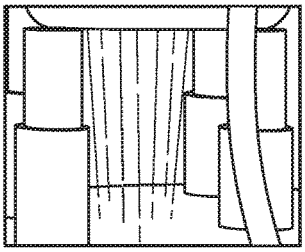
FIG. 8*a* is an image of argon/methane gas plasma produced by a high power impulse plasma source as described herein.
Figure 8B:
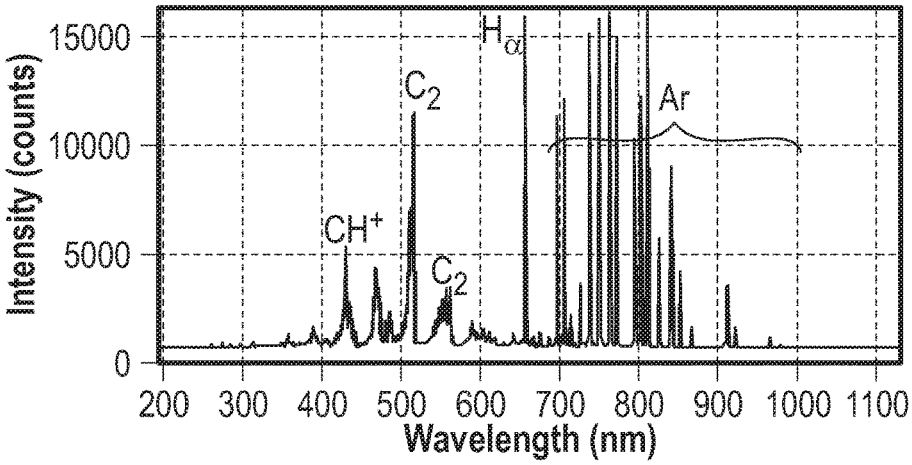
FIG. 8*b* illustrates an optical emission spectrograph of argon/methane gas plasma of FIG. 8*a;*
Figure 8C:
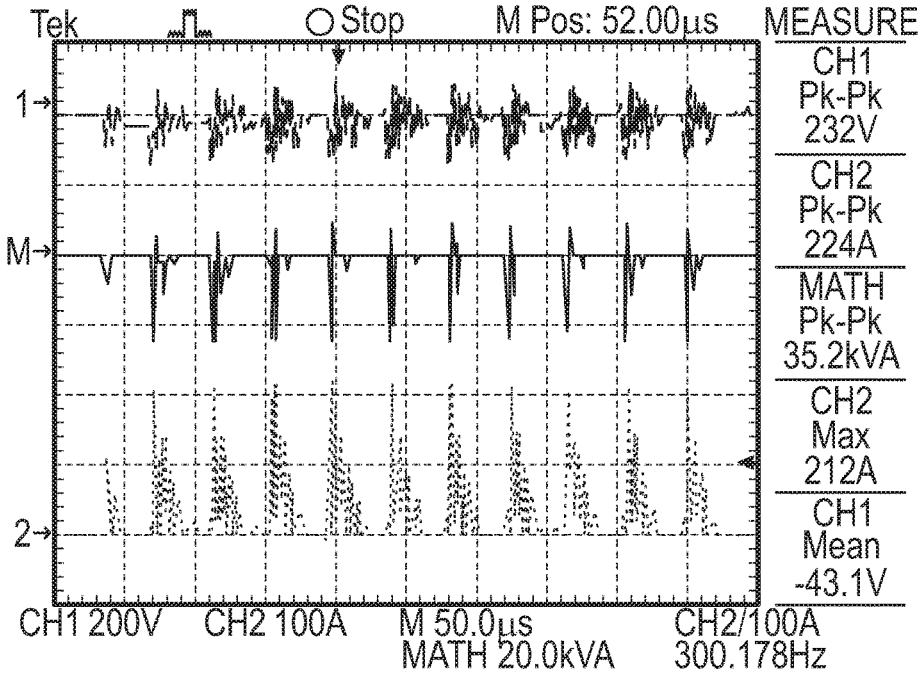
FIG. 8*c* illustrates an example of high peak power pulses applied to generate and maintain the argon/methane gas plasma of FIG. 8*a;*

In example two, $CH_4$ gas was introduced into the process chamber of FIG. 3 with an Ar carrier gas. $CH_4$ gas was introduced at a flow rate of 100 sccm and Ar was introduced at a flow rate of 3500 sccm. Power was applied to the power conducting electrode of the plasma source at 500 V at 20 microsecond pulses and at a frequency of 500 Hz to obtain an average power of 200 W with peak powers of 42.4 kW and peak currents of 232 Amps. FIG. 8*a* is an exemplary image of the $Ar/H_2$ plasma generated using the above process conditions. FIG. 8*b* is an example of an analysis of the plasma using optical emission spectrography indicating the presence of Ar, $C_2$, CH and H species in the plasma. FIG. 8*c* is an example of the power pulses applied to the electrode over time during the process.

Figure 9A:
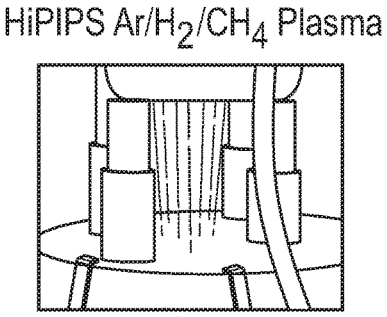
FIG. 9*a* is an image of argon/hydrogen/methane gas plasma produced by a high power impulse plasma source as described herein.
Figure 9B:
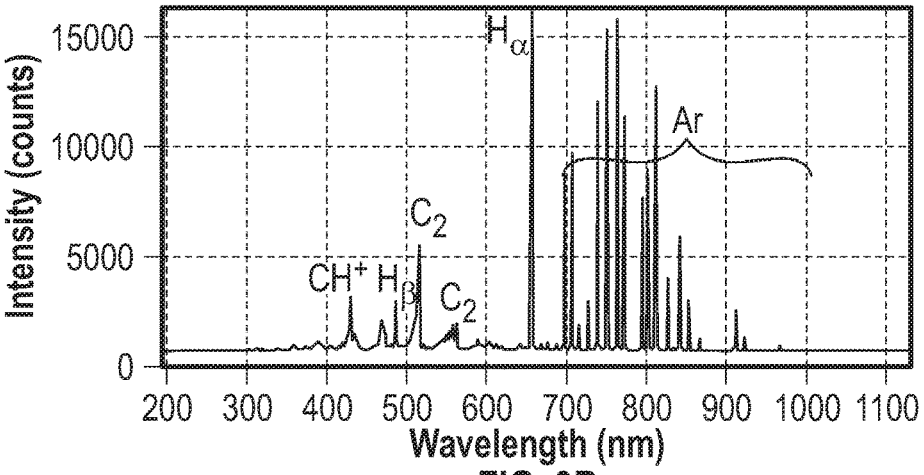
FIG. 9*b* illustrates an optical emission spectrograph of argon-hydrogen-methane gas plasma of FIG. 9*a;*
Figure 9C:
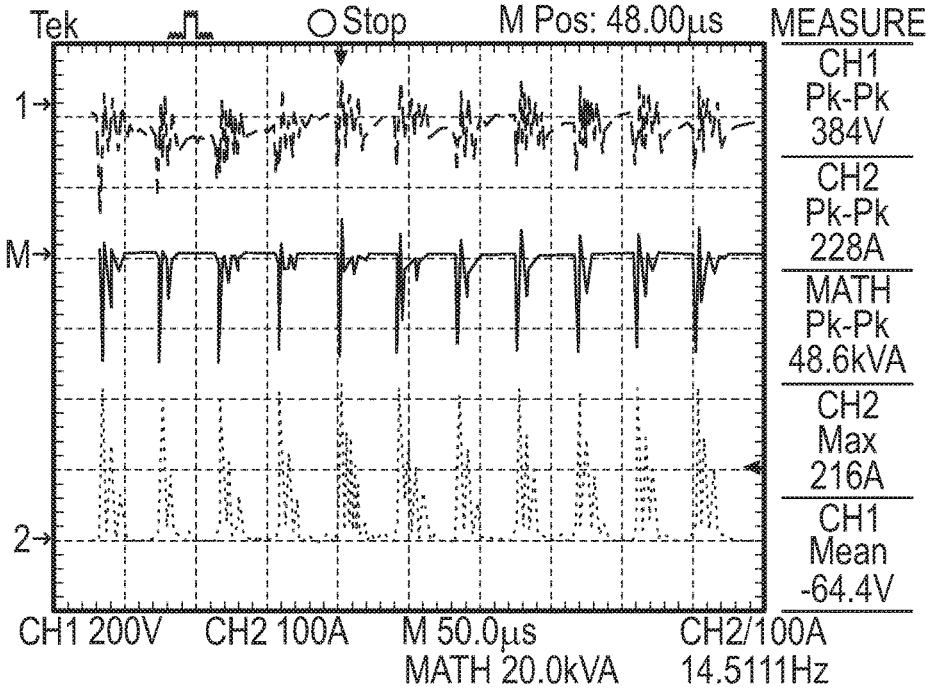
FIG. 9*c* illustrates an example of the high peak power pulses applied to generate and maintain the argon-hydrogen-methane gas of FIG. 9*a*.

In example three, a combination of $H_2$ gas and $CH_4$ gas was introduced into the process chamber of FIG. 3 with an Ar carrier gas. The $H_2$ gas was introduced at a flow rate of 200 sccm, $CH_4$ gas was introduced at a flow rate of 100 sccm, and Ar was introduced at a flow rate of 3500 sccm. 450 V of power at 20 microsecond pulses and at a frequency of 500 Hz was applied to the power conducting electrode of the plasma source to obtain an average power of 200 W with peak powers of 40.8 kW and peak currents at 188 Amps. FIG. 9*a* is an exemplary image of the $Ar/H_2/CH_4$ plasma generated using the above process conditions. FIG. 9*b* is an example of an analysis of the plasma using optical emission spectrography indicating the presence of Ar, C2, CH, $H_2$ and H in the plasma. FIG. 9*c* is an example of the power pulses applied to the electrode over time during the process.

Figure 10A:
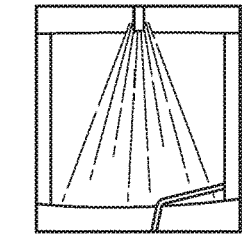
FIG. 10*a* illustrates an image of hydrogen gas plasma, without carrier gas, generated with a high power impulse plasma source as described herein.
Figure 10B:
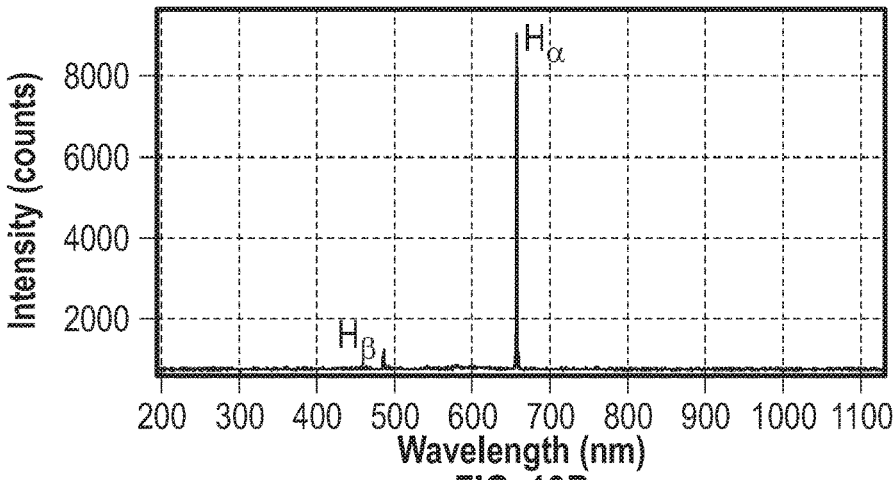
FIG. 10*b* illustrates an optical emission spectrum of the plasma of FIG. 10*a;*
Figure 10C:
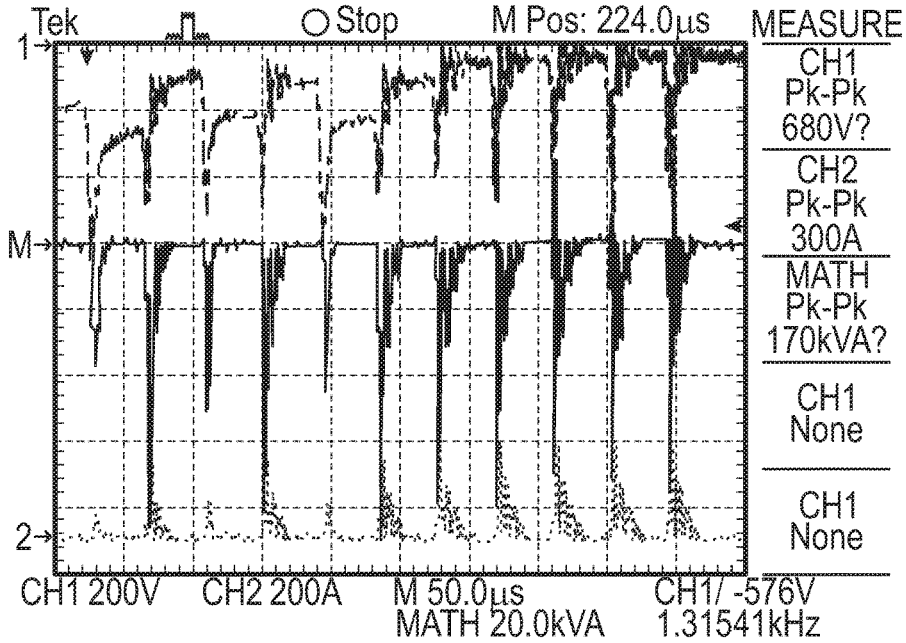
FIG. 10*c* illustrates an example of the high peak power pulses applied to generate and maintain the plasma of FIG. 10*a;*

Examples four and five use molecular gasses without carrier gasses in the high power impulse plasma source system and methods described herein. In example four, $H_2$ gas was introduced into the process chamber of FIG. 3. The process chamber was maintained at a pressure of 10 Torr. $H_2$ gas was introduced at a flow rate of 1,000 sccm. 700 V of power was applied for 20 microseconds at a frequency of 500 Hz to the power conducting electrode of the plasma source to obtain peak powers of 70.4 kW and peak currents at 300 Amps. FIG. 10*a* is an exemplary image of the Ar plasma generated using the above process conditions. FIG. 10*b* is an example of an analysis of the plasma using optical emission spectroscopy showing presence of only H and $H_2$ in the plasma. FIG. 10*c* is an example of the power pulses applied to the electrode over time during the process.

Figure 11A:
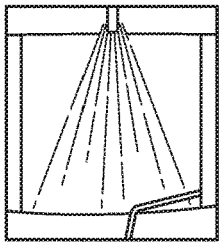
FIG. 11*a* illustrates an image of $H_2$ and $CH_4$ gas plasma.
Figure 11B:
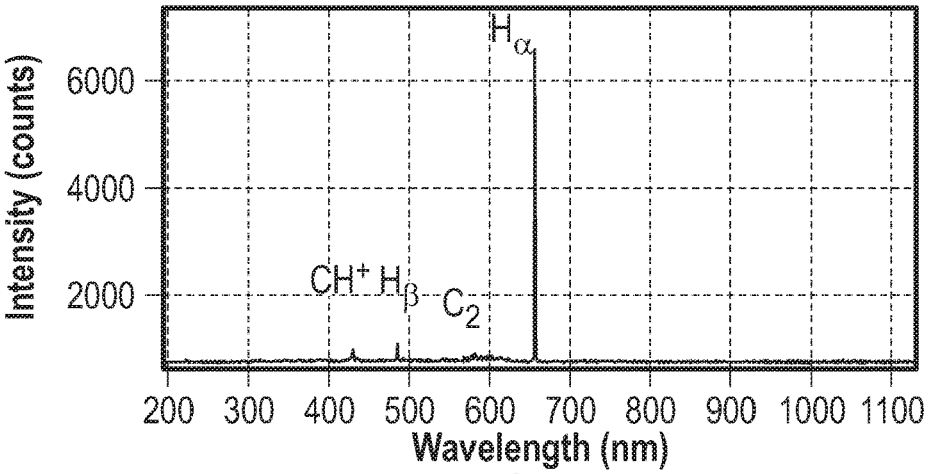
FIG. 11*b* illustrates an optical emission spectrum of the plasma of FIG. 11*a;*

In example five, a combination of $H_2$ gas and $CH_4$ gas was introduced into the process chamber of FIG. 3. The $H_2$ gas was introduced at a flow rate of 1000 sccm and the $CH_4$ gas was introduced at a flow rate of 10 sccm. 700 V of power was applied to the power conducting electrode of the plasma source for 20 microseconds at a frequency of 500 HZ to obtain peak powers of 53.6 kW and peak currents at 88 Amps. FIG. 11*a* is an exemplary image of the $Ar/H_2/CH_4$ plasma generated using the above process conditions. FIG.

Figure 11C:
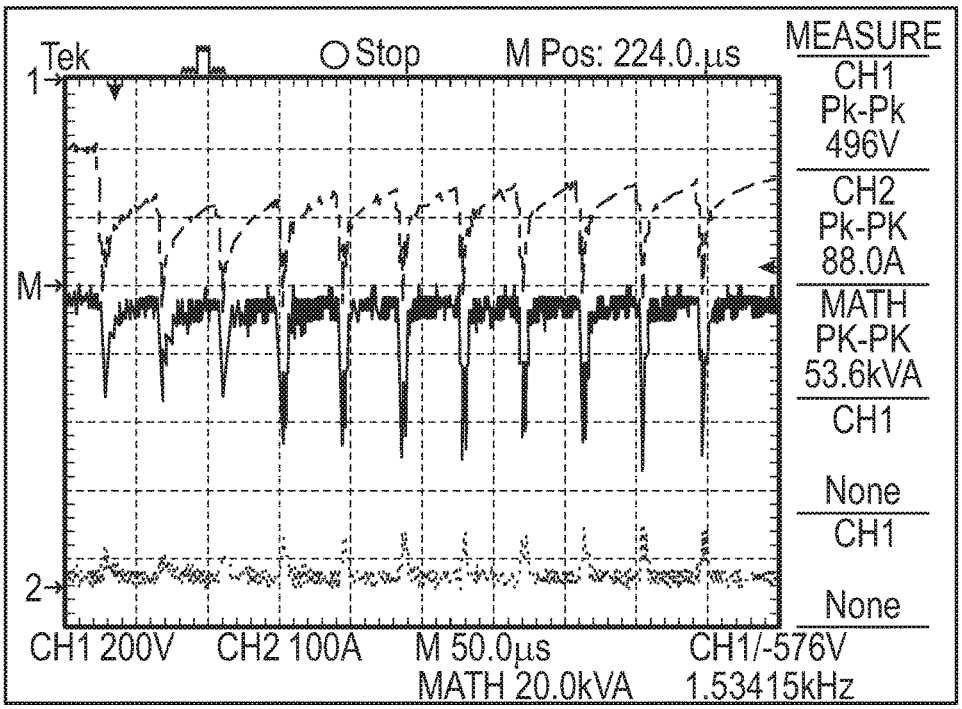
FIG. 11*c* illustrates an example of the high peak power pulses applied to generate and maintain the plasma of FIG. 11*c;*

11*b* is an example of an analysis of the plasma using optical emission spectroscopy indicating the presence of Ar, $C_2$, CH, $H_2$ and H in the plasma. FIG. 11*c* is an example of the power pulses applied to the electrode over time during the process.

Figure 12A:
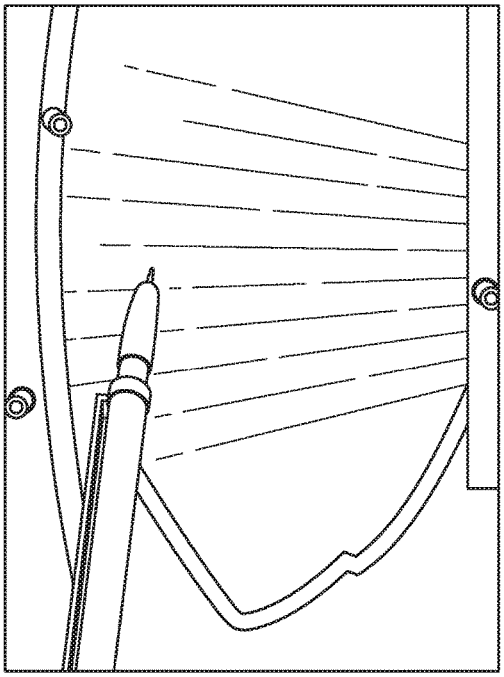
FIG. 12*a* is an image of a Langmuir probe inserted into a plasma to determine ion flux.
Figure 12B:
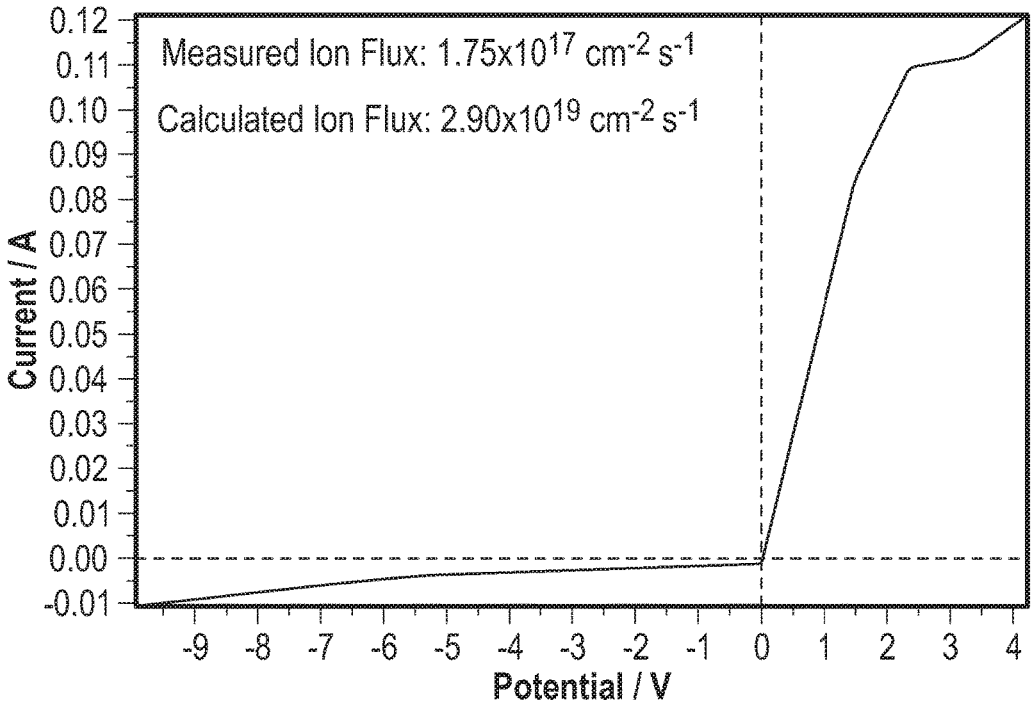
FIG. 12*b* is a graph of the measured ion flux.

A Langmuir probe analysis was performed of the high power impulse plasma source process using Ar plasma. 200 W of overall power (obtained with a peak power of 44 kW and peak current of 224 A, 500 V at 20 microseconds pulses at 500 Hz) was applied to the electrode of FIG. 3. Pressure was maintained at 1 Torr, Ar flow was maintained at 3500 sccm and the working distance between the probe and the source was 9 cm. The maximum current capability of the probe was 1 A. The measured Ar ion flux was on the order of $1\times10^{17}$ $cm^{-2}s^{-1}$ and the calculated ion flux was on the order of $1\times10^{19}$ $cm^{-2}s^{-1}$. FIG. 12*a* illustrates probe placement in the plasma and FIG. 12*b* illustrates the ion flux. The analysis demonstrated that a relatively high ion flux may result from the high power pulses.

Figure 13:
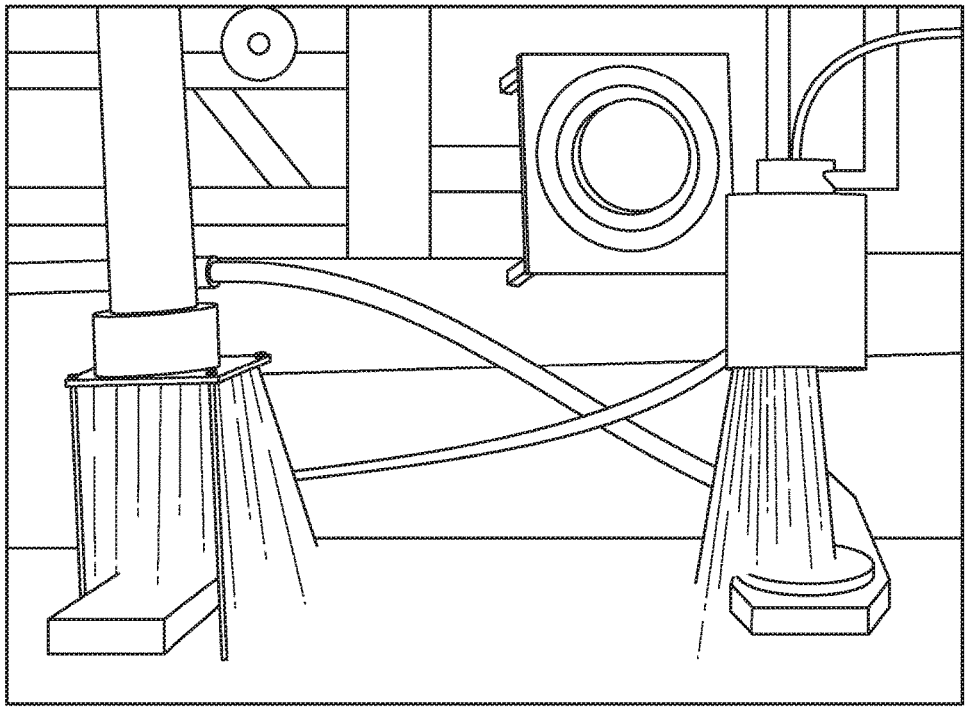
FIG. 13 is a side by side comparison of RF generated argon plasma and high power impulse generated argon plasma.

In example six, a comparison of the present process and an RF process under almost identical process conditions was performed. The process according to the present disclosure used the system illustrated in FIG. 3. The RF process used a similar system with an RF power supply. During the process, 5 slm (standard liters per minute) of Ar gas was introduced to the process chamber and a pressure of 1.5 Torr was maintained. 35 watts of power was applied to the RF process and an overall 35 watts of power was applied to the high power impulse process, wherein 70 kW pulses were applied for 20 microseconds in duration every 40 microseconds. FIG. 13 includes side by side images of the difference in the plasma produced by the RF and the present pulsed DC process.

Figure 14A:
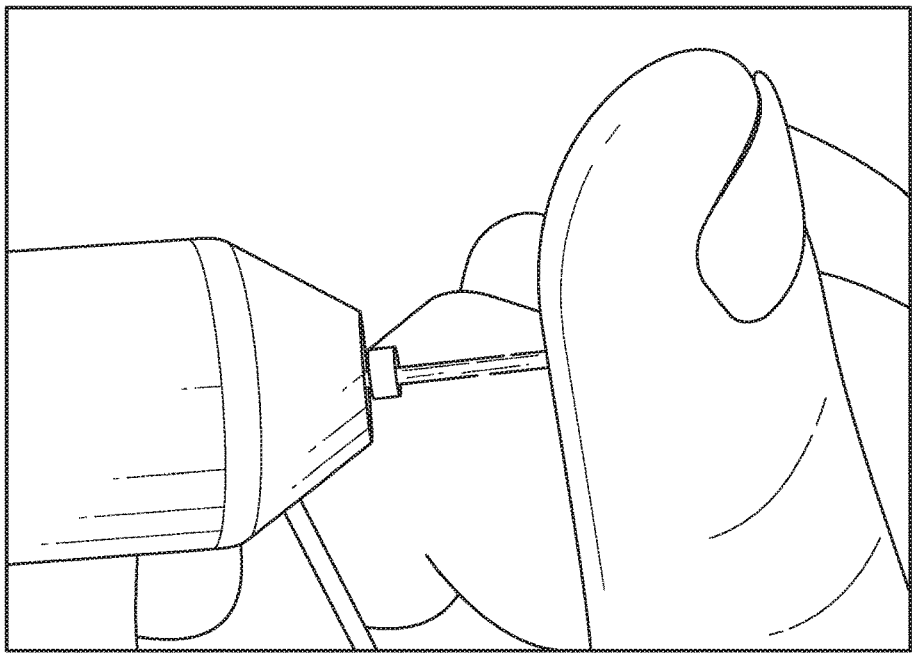
FIG. 14*a* is an image of a plasma generated using an AC atmospheric plasma jet.
Figure 14B:
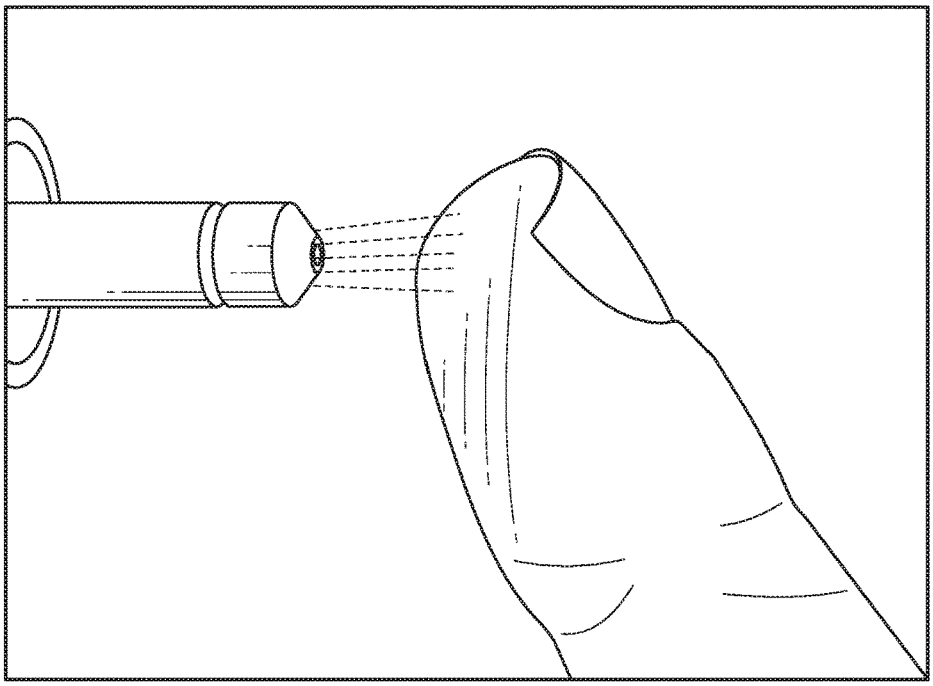
FIG. 14*b* is an image of a plasma generated using a high power impulse plasma source.

In example seven, a similar comparison was performed between the present process and an AC process under identical conditions was performed. Again, the process according to the present disclosure used the system illustrated in FIG. 3. The AC process used a similar system with an AC power supply. During the process, 3.5 slm (standard liters per minute) of Ar gas was introduced to the process chamber and a pressure of 1.5 Torr was maintained. 35 watts of power was applied to the AC process and an overall 35 watts of power was applied to the high power impulse process, wherein 70 kW pulses were applied for 20 microseconds in duration. FIGS. 14*a* and 14*b* include pictures illustrating the difference in the plasma produced by the AC process and the present pulsed DC process.

Figure 15A:
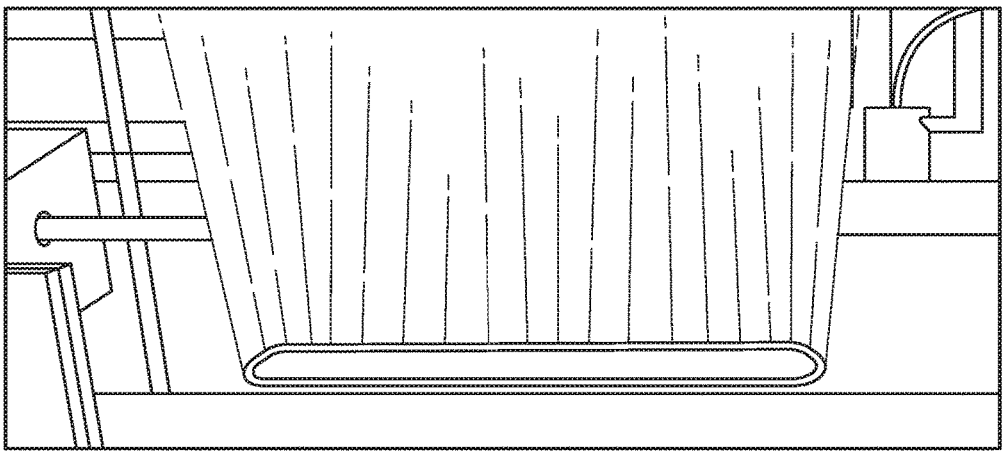
FIG. 15*a* is an image of plasma generated using a 12" long by 3" wide linear source run using a non-pulsed DC power source.
Figure 15B:
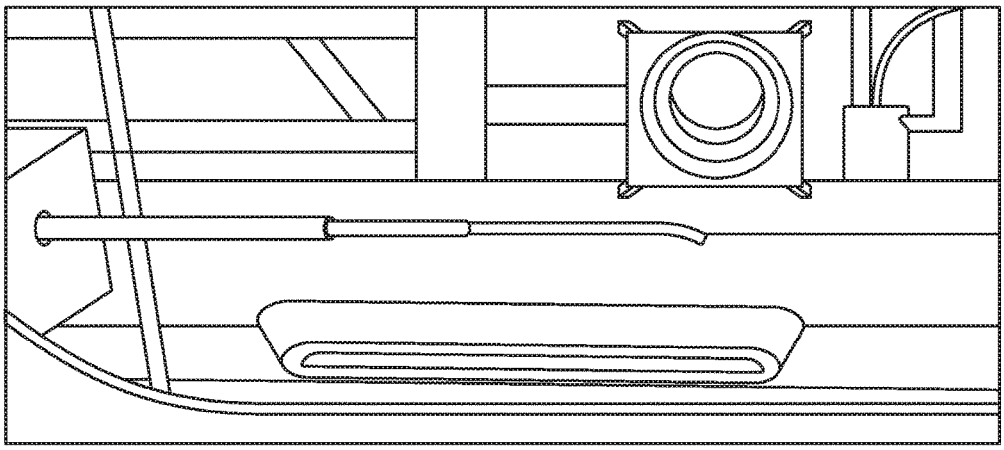
FIG. 15*b* is an image of plasma generated using a 12" long by 3" wide linear source run using a high power impulse generated argon plasma.

In addition in example eight, FIGS. 15*a* and 15*b* include pictures illustrating the difference in the plasma produced by a standard, non-pulsed DC process and the present DC process. Again, the process according to the present disclosure used the system illustrated in FIG. 3. The standard DC process used a similar system with a non-pulsed DC power supply. During the process, 5 slm (standard liters per minute) of Ar gas was introduced to the process chamber and a pressure of 1.5 Torr was maintained. 35 watts of power was applied to the standard DC process and an overall 35 watts of power was applied to the high power impulse process, wherein 70 kW pulses were applied for 20 microseconds every 40 microseconds.

Figure 16:
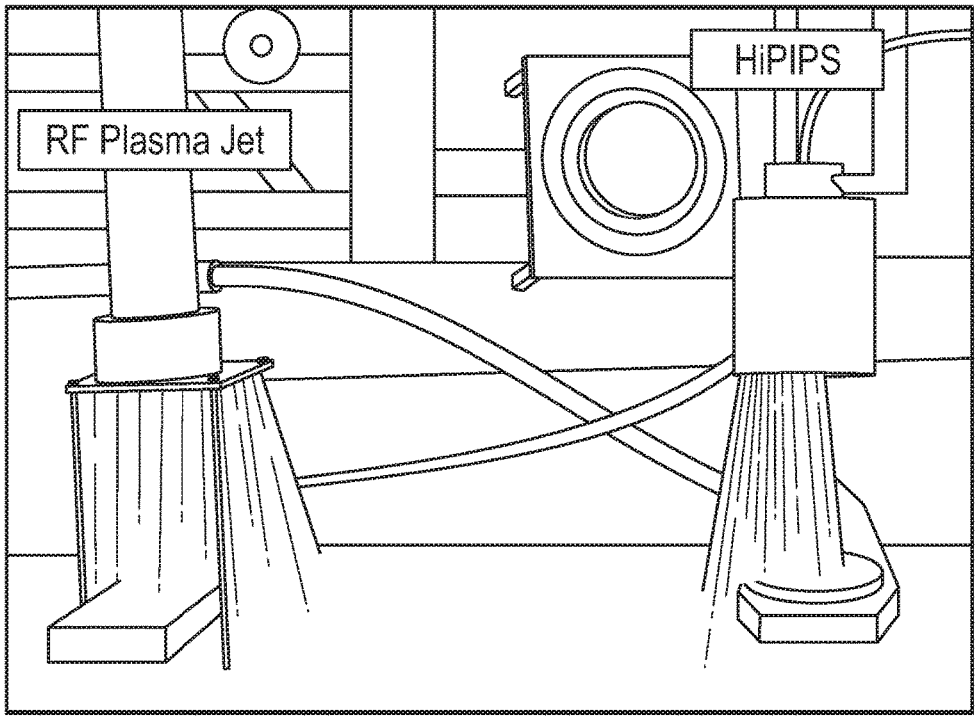
FIG. 16 is a side by side comparison of RF generated argon plasma and high power impulse generated argon plasma.

Another comparison was made in example 9 between the present process and an RF process. Again, the process according to the present disclosure used the system illustrated in FIG. 3. The RF process used a similar system with an RF power supply. In both processes Ar was introduced into the process chamber at 3.5 slm and pressure was maintained at 0.5 Torr. Power was applied in the pulsed DC system at a 70 kW for 20 microseconds with an overall average power of 35 watts. Power was applied in the RF system at 35 watts average. FIG. 16 illustrates a side by side comparison of images of the processes.

Figure 17:
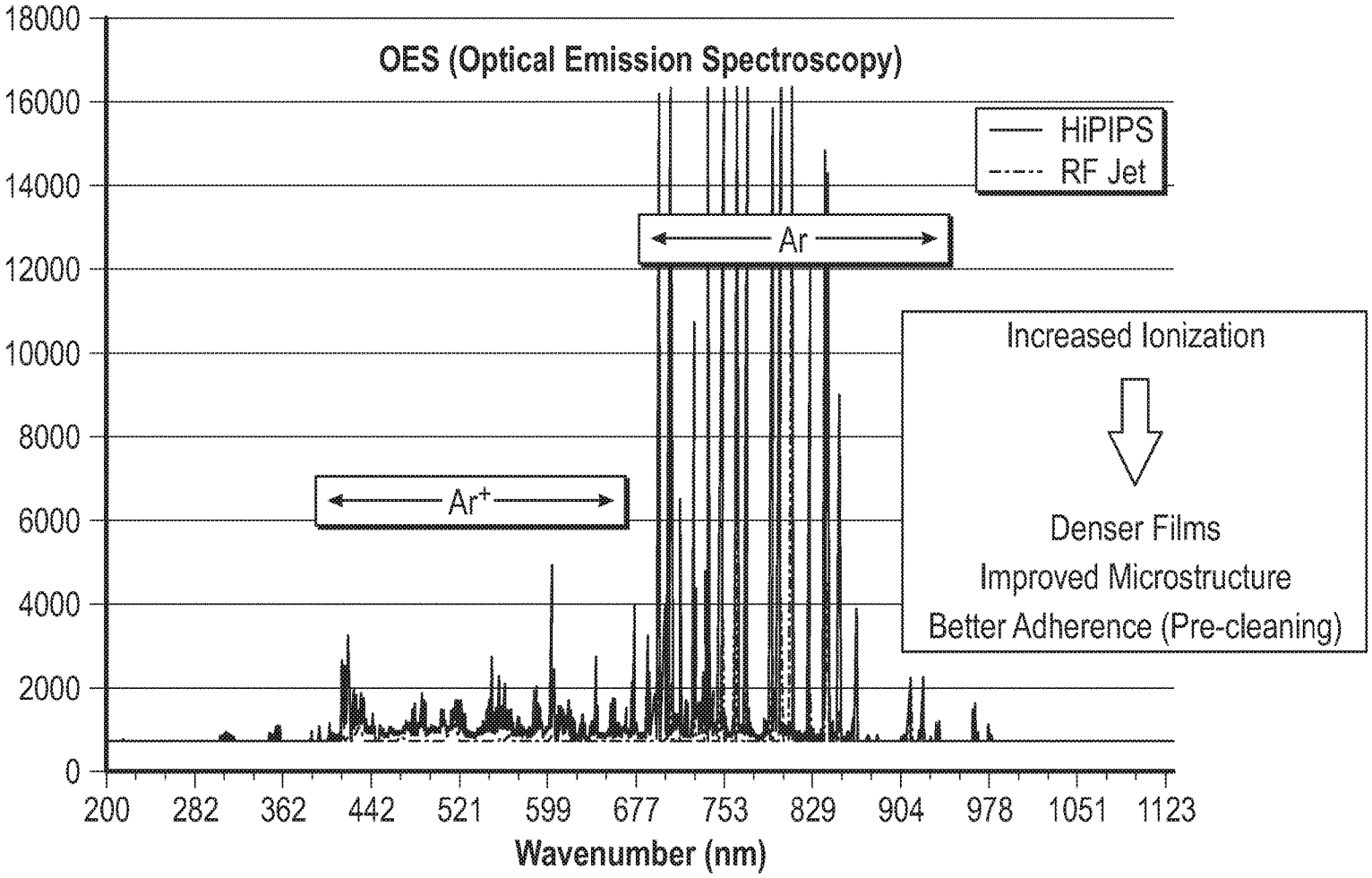
FIG. 17 illustrates an optical emission spectrograph of plasma produced using an RF source and the high power impulse plasma source described herein.

Optical emission spectroscopy was performed of the plasma of example 9 and an exemplary spectrograph is illustrated in FIG. 17. As can be seen, more argon molecules and argon ions were ionized by the process and present in the plasma using pulsed DC power as compared to the use of RF power. This may result in denser films, improved microstructure and better adherence due to relatively improved precleaning in the pulsed DC process over RF processes.

Figure 18:
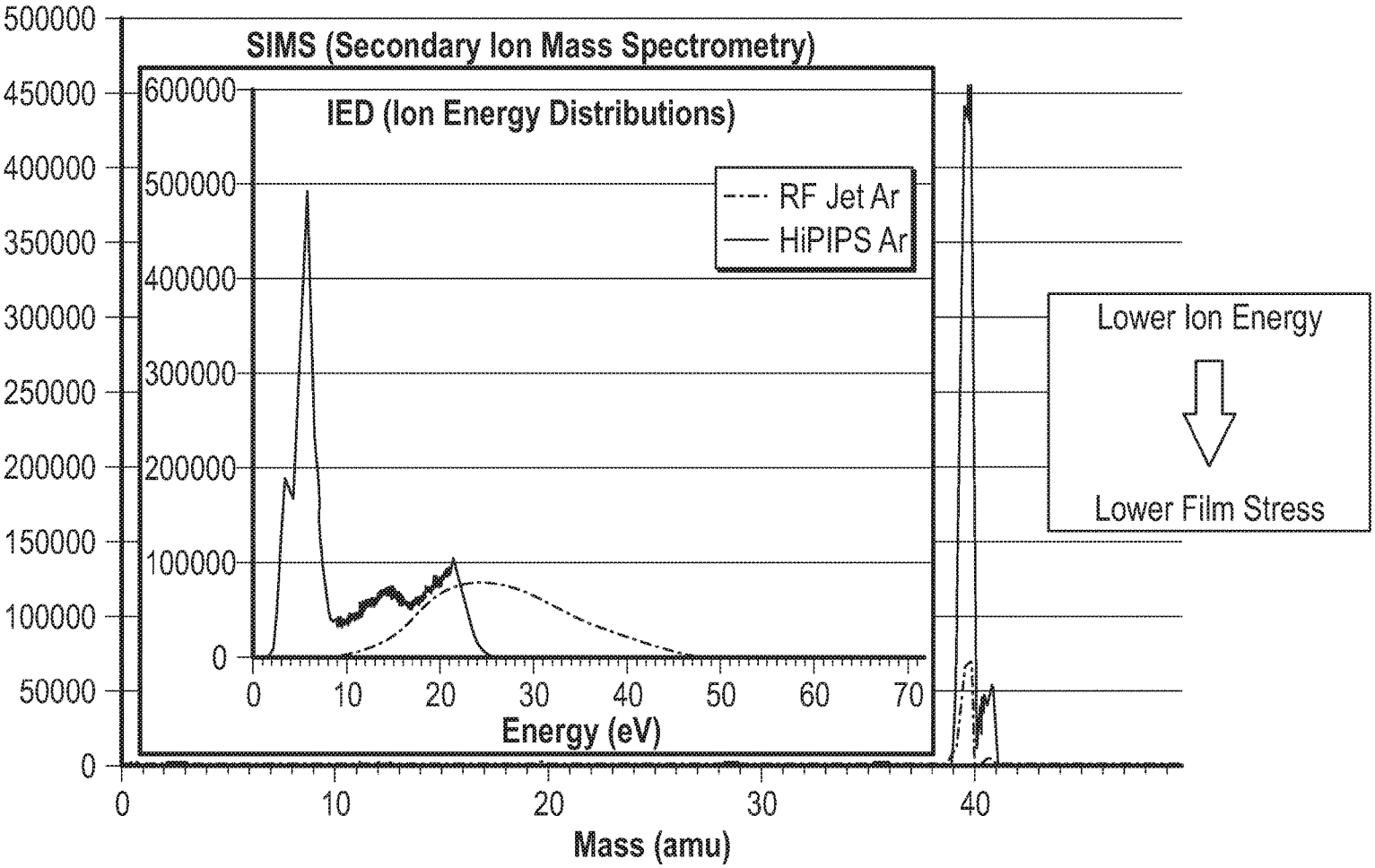
FIG. 18 illustrates ion energy distributions of RF generated argon plasma and the high power impulse generated argon plasma using secondary ion mass spectroscopy.

In addition, secondary ion mass spectrometry and ion energy distributions were measured of example 9 and the spectrographs are presented in FIG. 18. The secondary ion mass spectrometry was measured using a Hiden EQP analyzer and the ion energy distribution was measured using a retarding field analyzer. The secondary ion mass spectrometry detected the presence of $Ar^+$ ions in HiPIPS plasma, with an increase of 2 to 3 orders of magnitude as compare to $Ar^+$ ions detected in an RF plasma. The ion energy distribution detected the ion energy exhibited by the argon plasma in the pulsed DC process disclosed herein exhibited lower ion energy than that of the RF process. Lower ion energy during processing is understood to develop materials exhibiting lower film stress.

Figure 19:
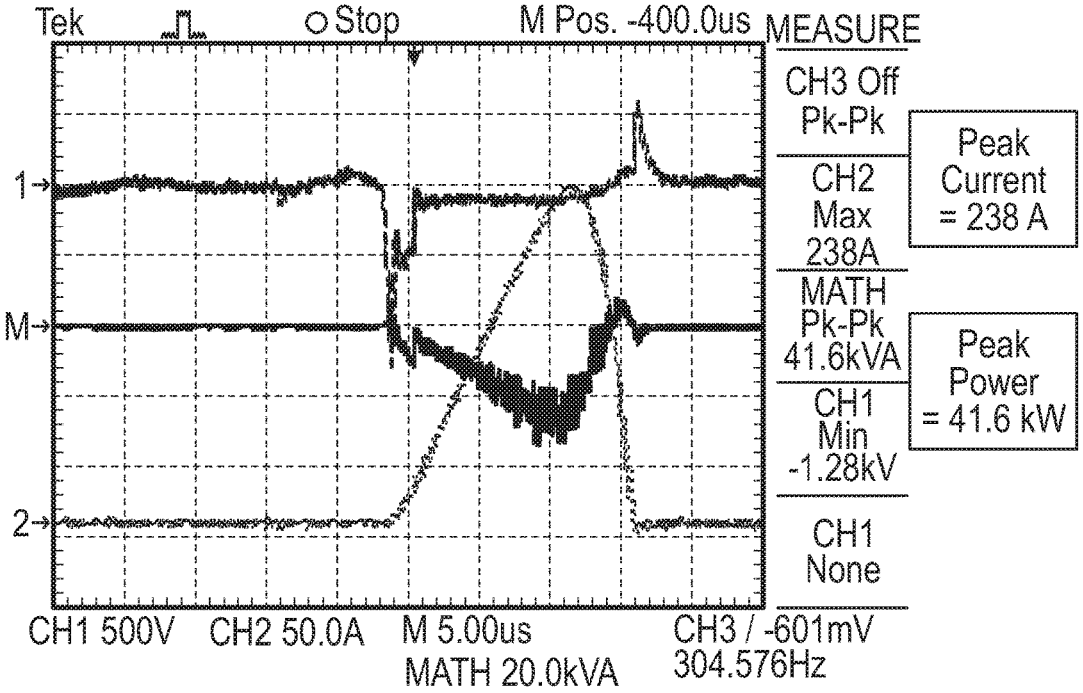
FIG. 19 illustrates of an example of the high peak power pulses applied to the high power impulse plasma of FIG. 16.

FIG. 19 illustrates the high power pulses applied during the high power impulse plasma process to generate and maintain the plasma.

The foregoing description of several methods and embodiments has been presented for purposes of illustration. It is not intended to be exhaustive or to limit the claims to the precise steps and/or forms disclosed, and obviously many modifications and variations are possible in light of the above teaching. It is intended that the scope of the invention be defined by the claims appended hereto.

The invention claimed is:

1. A method of generating a surface treating plasma, comprising:

positioning a substrate on a substrate holder in a process chamber;

supplying a mixture of gasses to said process chamber, said mixture of gasses including a precursor gas comprising carbon and hydrogen to a hollow power conducting electrode providing a gas nozzle, wherein:

said hollow power conducting electrode comprises a first end formed to include a first cathode opening extending therethrough, and an opposing second end formed to include a second cathode opening extending therethrough, said first cathode opening and said second cathode opening at least partially aligned to define a linear channel that extends between said first and second end of said cathode for gas flow;

said gas flows into said first cathode opening and through and in contact with said hollow power conducting electrode;

applying power pulses to said hollow power conducting electrode with a DC generator in the range of 40 kW to 100 kW at a frequency in the range of 0.1 Hz to 62.5 kHz, and with a pulse duration in the range of 0.1 microseconds to 3,000 microseconds, providing peak currents in the range of 175 Amps to 400 Amps, and forming a plasma from said gas;

said plasma discharges from said second cathode openings directly to said substrate wherein said second cathode opening is closest to said substrate holder and said second cathode opening to said substrate holder is in range of 10 micrometers to 5 millimeters; and treating a surface of a substrate with said plasma and forming a diamond like carbon coating.

2. The method of claim 1, wherein said hollow power conducting electrode is positioned a working distance from said substrate holder; and further comprising maintaining a pressure in the range of 50 mTorr to 760 Torr in said process chamber.

3. The method of claim 2, wherein said working distance is in the range of 1 mm to 20 mm from said substrate holder.

4. The method of claim 1, wherein a substrate processing temperature is in the range of 30 degrees C. to 150 degrees C.

5. The method of claim 1, wherein said plasma is non-thermal.

6. The method of claim 1, wherein said gas is supplied at a flow rate in the range of 1 to 10 liters per minute.

7. The method of claim 1, further comprising forming a vapor and introducing said vapor to said hollow power conducting electrode.

8. The method of claim 1, wherein at least one of said power pulses is modulated.

9. The method of claim 1, wherein said power pulses are applied at variable frequencies.

10. A high power impulse plasma source apparatus to provide a plasma output, comprising:

a process chamber;

a hollow power conducting electrode positioned within said process chamber, said hollow power conducting electrode providing a gas nozzle, wherein said hollow power conducting electrode comprises a first end formed to include a first cathode opening extending therethrough and an opposing second end formed to include a second cathode opening, said first cathode opening and said second cathode opening at least partially aligned to define a linear channel that extends between said first and second end of said cathode for gas flow, a gas supply in fluid communication with said first cathode opening, such that gas flows into said first cathode opening and through and in contact with said hollow power conducting electrode, wherein said gas supply is configured to provide a mixture of gasses including a precursor gas comprising carbon and hydrogen; and said plasma output to discharge from said second cathode openings directly to said substrate wherein said second cathode opening is closest to a substrate holder and said second cathode opening to said substrate holder is in range of 10 micrometers to 5 millimeters; and a DC generator coupled to said hollow power conducting electrode, wherein said DC generator is configured to provide power pulses in the range of 40 kW to 100 kW at a frequency in the range of 0.1 Hz to 62.5 kHz, and with a pulse duration in the range of 0.1 microseconds to 3,000 microseconds, providing peak currents in the range of 175 Amps to 400 Amps.

11. The apparatus of claim 10, further comprising a substrate holder positioned within said process chamber, wherein said hollow power conducting electrode is positioned within said process chamber; and a vacuum pump coupled to said process chamber configured to maintain a pressure in the range of 50 mTorr to 760 Torr in said process chamber.

12. The apparatus of claim 11, wherein said hollow power conducting electrode is position-able at any working distance in the range of 1 mm to 20 mm from said substrate holder.

13. The apparatus of claim 10, further comprising plasma diagnostics coupled to said process chamber.

14. The apparatus of claim 10, wherein said DC generator is configured to modulate one or more of said power pulses.

15. The apparatus of claim 10, wherein said DC generator is configured to provide said power pulses at variable frequencies.

16. The apparatus of claim 10, wherein said hollow power conducting electrode is perforated.

17. The apparatus of claim 10, wherein said hollow power conducting electrode has an opening in the range of 0.1 microns to 50 microns.

18. The apparatus of claim 10, wherein said gas supply is configured to deliver a vapor.

* * * * *